US006962376B2

(12) United States Patent
Palzkill et al.

(10) Patent No.: US 6,962,376 B2
(45) Date of Patent: Nov. 8, 2005

(54) ROTARY LOCK SEAL

(75) Inventors: Raymond G. Palzkill, Fremont, NE (US); Keith R. Feilmeier, Omaha, NE (US)

(73) Assignee: Gabriel Technologies Corporation, Omaha, NE (US)

( * ) Notice: Subject to any disclaimer, the term of this patent is extended or adjusted under 35 U.S.C. 154(b) by 26 days.

(21) Appl. No.: 10/388,189

(22) Filed: Mar. 13, 2003

(65) Prior Publication Data

US 2004/0124641 A1 Jul. 1, 2004

Related U.S. Application Data

(60) Provisional application No. 60/364,203, filed on Mar. 14, 2002.

(51) Int. Cl.[7] ..... E05B 39/02
(52) U.S. Cl. ..... 292/327; 292/307 A
(58) Field of Search ..... 292/307 A, 324, 292/327

(56) References Cited

U.S. PATENT DOCUMENTS 1,830,348 A * 11/1931 Carman et al. ..... 411/350
2,319,753 A * 5/1943 Smith et al. ..... 70/50
3,730,578 A * 5/1973 Gerlach ..... 292/318
4,280,726 A * 7/1981 McCoag ..... 292/327
4,802,700 A * 2/1989 Stevenson et al. ..... 292/327
5,127,687 A * 7/1992 Guiler ..... 292/327
6,039,365 A * 3/2000 Rogatnev ..... 292/327
D454,773 S 3/2002 Gilbert et al.
D455,330 S 4/2002 Gilbert et al.
D455,636 S 4/2002 Gilbert et al.
D455,945 S 4/2002 Gilbert et al.
6,406,074 B1 * 6/2002 Mahaney ..... 292/327
D462,600 S 9/2002 Gilbert et al.

* cited by examiner

*Primary Examiner*—Gary Estremsky

(57) ABSTRACT

A rotary lock seal includes a pin with an elongated shaft and an enlarged head at a rearward end. The forward end of the shaft has a peg projecting coaxially therefrom. An end cap has an enlarged head at a forward end and a central bore extending forwardly through the rearward end, forming an annular sidewall. An annular groove on the inner surface of the cap sidewall corresponds with a groove formed on the peg to retain a locking ring within the pair of aligned grooves when the cap is positioned over the peg on the pin. The locking ring prevents removal of the cap once secured on the pin.

3 Claims, 3 Drawing Sheets

ROTARY LOCK SEAL

CROSS-REFERENCES TO RELATED APPLICATIONS

Applicant claims the benefit of U.S. Provisional Application Ser. No. 60/364,203, filed Mar. 14, 2002.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to apparatus for securing the latch of a shipping container, and more particularly to an improved lock seal on a rotary lock for preventing unauthorized access to a shipping container.

(2) Background Information

Shipping containers are widely used in the transportation of various types of goods, both domestically and internationally. However, the task of securing such containers against break-ins has proven difficult to solve.

Prior art attempts include such devices as hasp protectors and various bolt seals. For example, U.S. Pat. No. 5,118,149 discloses a container hasp protector with a metal box with an open rearward side. A shield plate on the front face extends between the sides to form upper and lower openings in the face between the shield plate and the top and bottom walls of the box. The box encloses the container's hasp, to protect against damage by a thief.

Although this apparatus provides protection for the hasp, it still leaves the shank of the security seal/pin open for tampering or cutting, through the openings in the front face.

Similarly, padlock-type security devices such as those disclosed in U.S. Pat. Nos. 5,477,710, 5,146,771 and 4,898,008 suffer the problem of exposure of the shanks or shackles to bolt-cutters or other shears.

U.S. Pat. Nos. 6,010,166, 6,009,731 and 6,036,240 all disclose bolt seal lock devices that utilize a pin with an enlarged head on an upper end and a lock body on a lower end, the shank of the pin journaled though aligned apertures in a housing to cover a portion of a keeper bar and prevent operation of the keeper bar while the cover is in place. However, each of these devices incorporates an enlarged locking body which is preferably releasable, and exposed on one side. This exposed locking body can therefore be accessed by unauthorized persons, and potentially permit tampering and prying of the locking body off the shank of the pin.

BRIEF SUMMARY OF THE INVENTION

It is therefore a general object of the present invention to provide an improved security system for cargo containers with an improved seal pin.

Yet another object is to provide an improved seal pin for a cargo latch which is simple and economical to manufacture.

These and other objects of the present invention will be apparent to those skilled in the art.

The rotary lock seal of the present invention includes a pin with an elongated shaft and an enlarged head at a rearward end. The forward end of the shaft has a peg projecting coaxially therefrom. An end cap has an enlarged head at a forward end and a central bore extending forwardly through the rearward end, forming an annular sidewall. An annular groove on the inner surface of the cap sidewall corresponds with a groove formed on the peg to retain a locking ring within the pair of aligned grooves when the cap is positioned over the peg on the pin. The locking ring prevents removal of the cap once secured on the pin.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
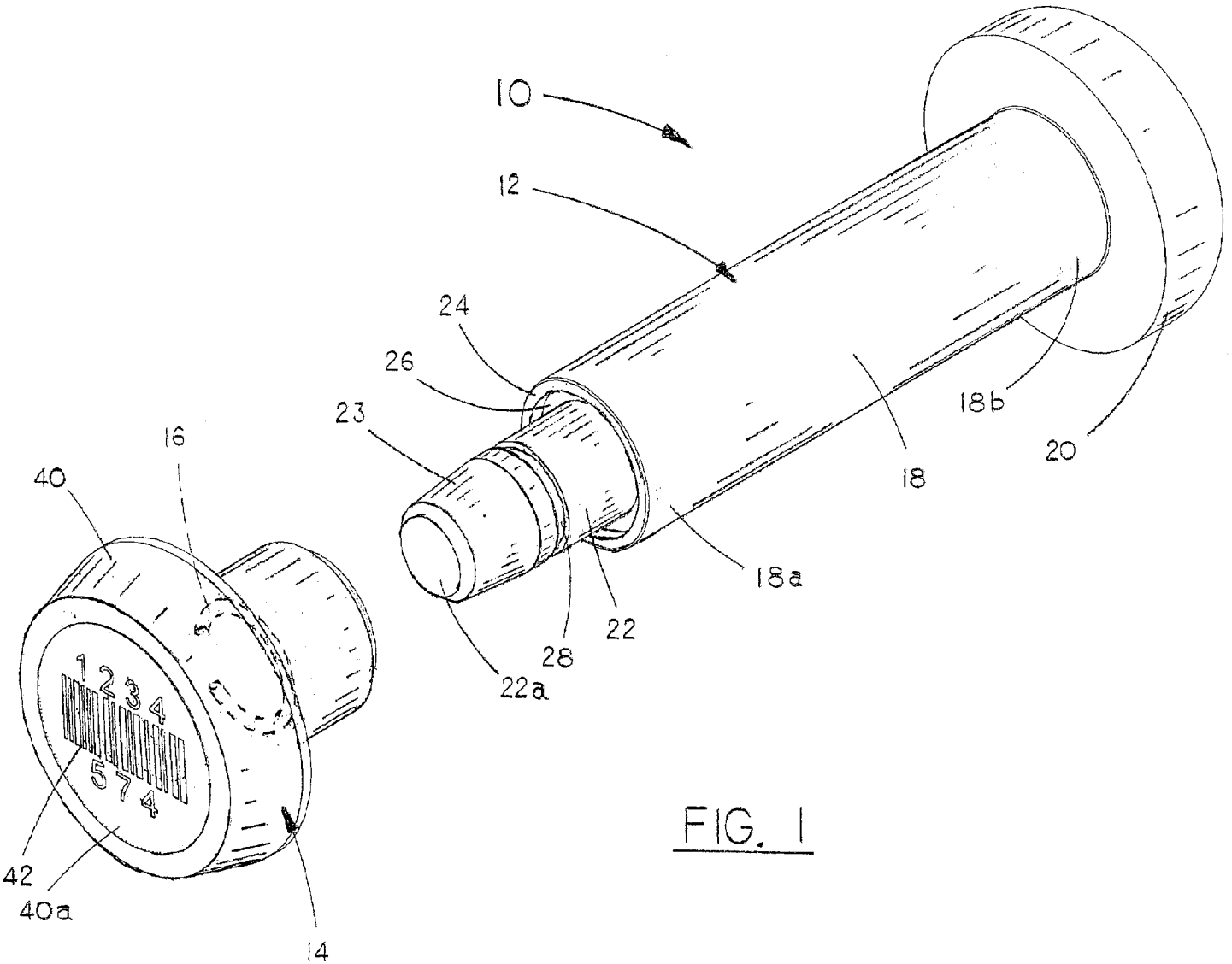
FIG. 1 is a perspective view of the rotary lock seal of the present invention with the cap separated from the pin, prior to connection.
Figure 2:
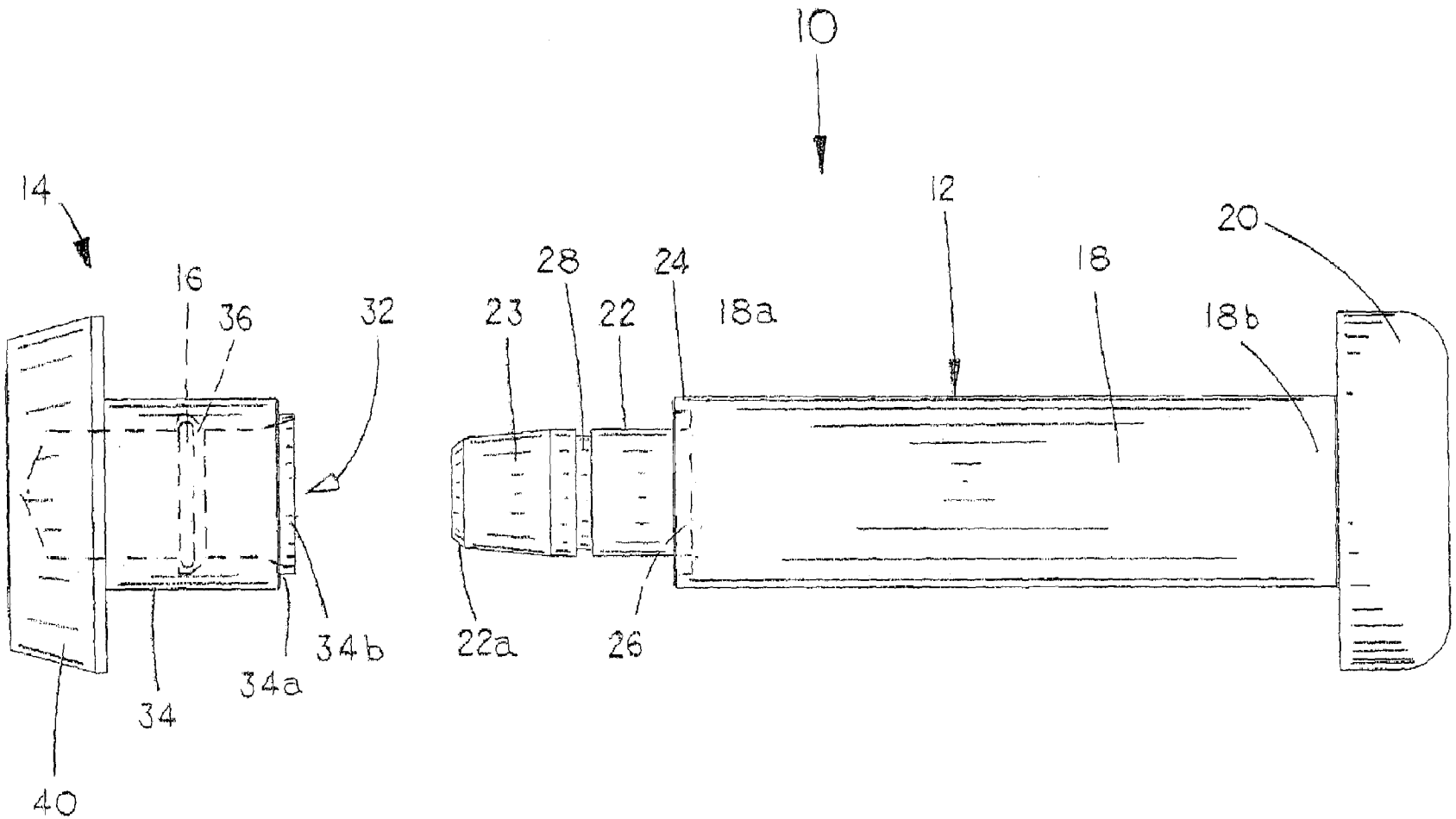
FIG. 2 is an elevational view of the lock seal shown in FIG. 1.

Referring to the drawings, in which similar or corresponding parts are identified with the same reference numeral, and more particularly to FIGS. 1 and 2, the rotary lock seal of the present invention is designated generally at 10 and includes three major components, namely, a pin 12, a cap 14, and a locking ring 16.

Seal pin 12 is preferably formed of hardened steel or similar material that is not easily bent, cut or broken. Seal pin 12 includes an elongated solid cylindrical shaft 18 with a forward end 18*a* and a rearward end 18*b*. An enlarged head 20 is formed on the rearward end 18*b* of shaft 18, with a diameter larger than that of shaft 18 to prevent the pin 12 from passing through ears of a latch or other similar lock. The forward end 18*a* of shaft 18 includes a forwardly projecting peg 22 that is cylindrical in shape and coaxial with shaft 18. Peg 22 has a diameter less than the diameter of shaft 18.

An annular wall 24, having an outer diameter equal to the diameter of shaft 18, projects forwardly from the shaft and is coaxial therewith. Annular wall 24 has an inner diameter greater than the diameter of peg 22 so as to form an annular channel 26 between wall 24 and peg 22. Peg 22 extends a length greater than the length of annular wall 24, as shown in the drawings.

A forward portion of peg 22 is tapered from a larger diameter at a rearward end to a narrower diameter at the forward end to form a generally conical portion 23 that will assist in aligning peg 22 with a bore formed in cap 14. An annular groove 28 is formed around the circumference of peg 22 approximately midway between the forward end 22*a* of peg 22 and the forward end 18*a* of pin shaft 18, and spaced slightly rearwardly of the rearward end of conical portion 23 of peg 22. Groove 28 will receive locking ring 16 therein, to retain end cap 14 in position on peg 22, as described in more detail hereinbelow.

Locking ring 16 is of conventional design, with a toroidal shape, and split to permit the ring to expand in diameter. Preferably, the ring is formed of steel or similar material with memory to return to its original shape after expansion.

It can be seen that the conical portion 23 on peg 22 will cause the locking ring 16 to gradually expand in diameter until the ring falls into the groove 28, where it will contract to its original diameter. Groove 28 has a depth approximately one-half the thickness of the locking ring 16, such that the ring will project outwardly beyond the diameter of peg 22 when it is received in groove 28. Groove 28 is generally rectangular in cross-section, with flat forward and rearward walls perpendicular to the longitudinal axis of shaft 18 and peg 22. This shape assists in retaining locking ring 16 in position within groove 28.

End cap 14 is case-hardened steel and generally cylindrical in shape, with a forward end 14*a* and a rearward end 14*b*. A generally cylindrical bore 32 is formed in the rearward end 14*a* of cap 14 and extends forwardly along the longitudinal axis of the cap towards the forward end 14*b*, to form a generally cylindrical sidewall 34. Sidewall 34 has an outer diameter equal to the diameter of pin shaft 18, so that the two will be in flush alignment when cap 14 is attached to pin 12.

Bore 32 has a diameter slightly greater than the diameter of peg 22, to slidably receive peg 22 therein. An annular groove 36 projecting radially outward into the inner surface of sidewall 34 is formed to receive locking ring 16 therein. As peg 22 slides forwardly into bore 32, conical portion 23 will expand the diameter of locking ring 16 radially outwardly into groove 36. Once ring 16 contracts into groove 28 on peg 22, the projecting thickness of the ring 30 will project into groove 36 of cap 14 and secure peg 22 in end cap 14. Thus, the diameter of bore 32 is less than the combined diameter of the locking ring 16 and peg 22 when the ring 16 is received within groove 28.

Preferably, groove 36 in end cap 16 has a flat forward surface, perpendicular to the longitudinal axis of the peg, and a generally conical rearward surface with a reducing diameter from the forward end to the rearward end of the conical surface. Similarly, bore 32 preferably includes a conical entry surface, reducing in diameter from the rearward end towards the forward end thereof for a short length of the rearward end of bore 32. These conical surfaces assist in the insertion of locking ring 16 through bore 32 and into groove 36 of cap 14, prior to the introduction of peg 22 of pin 12. Once locking ring 16 is in position within groove 36, the insertion of peg 22 into bore 32 will cause the ring 16 to expand in diameter within groove 36 as conical portion 23 contacts ring 16. The flat forward surface of groove 36 prevents ring 16 from moving forwardly during this expansion of ring 16.

Figure 3:
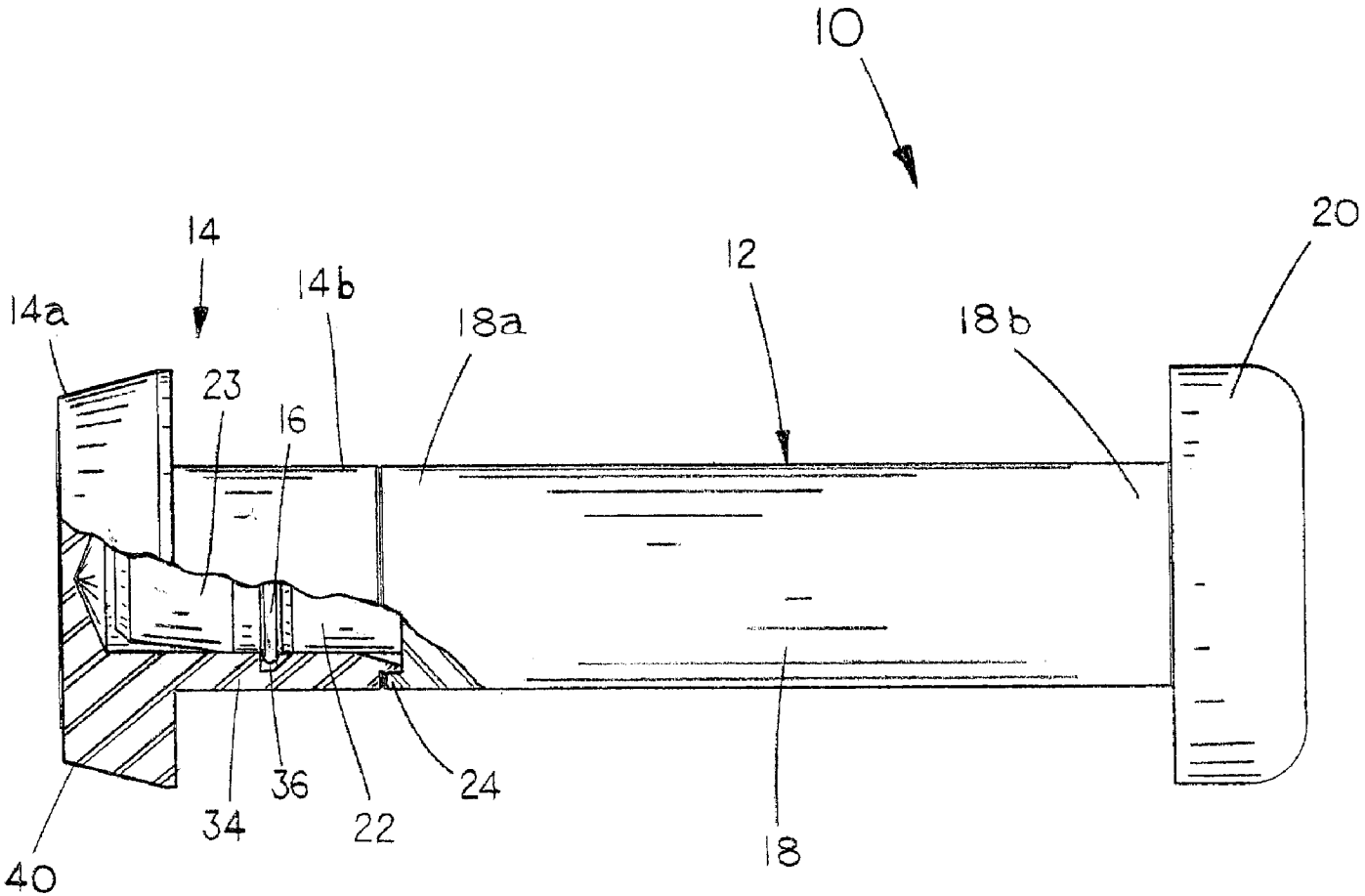
FIG. 3 is an elevational view similar to FIG. 2, but with the cap removed from the pin.

The rearward end 34*a* of cap sidewall 34 has an annular, cylindrical notch formed therein, reducing the diameter of sidewall 34 at end 34*a*. The reduced-diameter sidewall 34*b* has a shape and size to fit within channel 26 in forward end 18*a* of pin shaft 18, with cap sidewall 34 in flush alignment with the shaft sidewall 18 when cap 14 is attached to the end of pin 12, as show in FIG. 3.

The forward end 14*a* of cap 14 has an enlarged head 40, similar in diameter to head 20 on shaft 18. A bar code 42 is printed on the outer face 40*a* of head 40, for identification and tracking.

Once cap 14 is secured on pin 12 using locking ring 16, it can only be removed by the destruction of locking ring 16. The preferred method of removal is by the application of a punch on the center of the forward end of the cap 14. The punch is forced through the cap 14 and pushes peg 22 in a rearward direction with sufficient force to shear locking ring 16. In this way, cap 14 and ring 16 are destroyed, but pin 12 may be reused. Preferably, a removal tool will grip the projecting edges of cap 14 as a resisting force while the punch is pushed through the cap 14.

It can be seen that the provision of peg 22 within the interior of the outside diameter of shaft 18 assists in protecting the peg from being cut or otherwise broken. In addition, it is more difficult to attempt to remove the end cap 14 because of the provision of sidewall 34 on cap 14 with a diameter equal to the shaft 18. In order to attempt to remove cap 14 it would be necessary to grip a portion of the shaft 18, spaced a distance from the cap 14, rather than simply prying the cap 14 from a point immediately adjacent the cap.

Whereas the invention has been shown and described in connection with the preferred embodiment thereof, many modifications, substitutions and additions may be made which are within the intended broad scope of the appended claims.

What is claimed is:

1. A rotary lock seal, comprising:

a single-piece pin having a rigid elongated cylindrical shaft with forward and rearward ends, a longitudinal axis and an outer diameter;

a head formed on the rearward end of the shaft with an enlarged diameter greater than the diameter of the shaft;

a generally cylindrical peg projecting forwardly and coaxially from the forward end of the shaft, and having a diameter less than the diameter of the shaft;

said peg having a conical shaped forward portion, tapering from a cylindrical rearward portion to a smaller diameter at the forward end of the peg;

an annular groove formed in the peg and extending around a circumference of the peg;

a single-piece end cap for securement to the peg, said cap having a forward end, a rearward end and a central bore extending from the rearward end towards the forward end to form a generally cylindrical sidewall in the rearward end of the cap with inward and outward surfaces;

said end cap having an annular groove formed on the inward surface of the sidewall, oriented perpendicular to a longitudinal axis of the bore and located a distance from the rearward end of the cap to align with said annular groove in the peg when the cap is secured to the pin; and a locking ring for securing the end cap to the peg, the locking ring having a split toroidal shape;

said peg groove having a depth such that the locking ring will project radially outwardly from the peg groove when the ring is journaled within the peg groove;

said peg groove being formed in the rearward cylindrical portion of the peg and spaced rearwardly of the forward conical portion;

said bore having an inner diameter greater than the diameter of the peg but less than the combined diameters of ring and peg when the ring is positioned within the peg groove;

said cap having a head portion at the forward end with an enlarged diameter greater than an outer diameter of the sidewall;

said groove in the cap having a diameter and depth to permit the locking ring to expand in diameter a distance sufficient to permit the ring to slide over the circumference of the peg and into the peg groove;

said groove in said cap sidewall having a flat forward wall oriented perpendicular to the longitudinal axis of the bore, to prevent forward longitudinal displacement of the ring when positioned within the cap groove;

said groove in said cap sidewall groove having a sloped rearward wall decreasing in diameter in the rearward direction;

whereby the cap is secured to the peg and pin when the cap groove is aligned with the peg groove and the ring is positioned within the aligned grooves;

said peg groove having a generally rectangular shaped cross-section, with flat, parallel forward and rearward walls to prevent longitudinal displacement of the ring when positioned within the peg groove.

2. The seal of claim 1, wherein said cap sidewall outer diameter is equal to the diameter of the pin shaft, such that the cap sidewall is in flush alignment with the pin shaft when the cap is secured to the pin.

3. The seal of claim 2, wherein:

said pin shaft further including:

an annular wall projecting forwardly from the forward end of the shaft;

said annular wall having an outer diameter equal to the diameter of the shaft and an inner diameter greater than the diameter of the peg so as to form an annular channel between the annular wall and peg; and said end cap further including an annular, cylindrical notch formed in the rearward end of the sidewall, of a cross-sectional shape matching the annular wall on the pin, and located to slidably fit within the annular channel on the pin when the cap is secured to the pin.

* * * * *